US006316176B1

(12) United States Patent
Elst et al.

(10) Patent No.: US 6,316,176 B1
(45) Date of Patent: Nov. 13, 2001

(54) PHOTOSENSITIVE SILVER HALIDE ELEMENT COMPRISING CHEMICALLY SENSITIZED EMULSION GRAINS AND METHOD TO PREPARE THEM

(75) Inventors: Kathy Elst, Kessel; Johan Loccufier, Zwijnaarde, both of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/621,962

(22) Filed: Jul. 21, 2000

Related U.S. Application Data

(60) Provisional application No. 60/147,386, filed on Aug. 6, 1999.

(30) Foreign Application Priority Data

Jul. 23, 1999 (EP) ..... 99202439

(51) Int. Cl.[7] ..... G03C 1/09; G03C 1/46; G03C 1/035

(52) U.S. Cl. ..... 430/502; 430/600; 430/603; 430/567

(58) Field of Search ..... 430/600, 603, 430/502, 567

(56) References Cited

U.S. PATENT DOCUMENTS

| | | | |
|---|---|---|---|
| 5,459,027 | 10/1995 | Takada et al. | 430/603 |
| 5,561,033 | 10/1996 | Kashi et al. | 430/603 |
| 5,654,134 | 8/1997 | Morimura et al. | 430/603 |
| 5,677,120 | 10/1997 | Lushington et al. | 430/603 |

*Primary Examiner*—Richard L. Schilling
(74) *Attorney, Agent, or Firm*—Breiner & Breiner, L.L.C.

(57) ABSTRACT

A method has been described of chemically sensitizing a silver halide emulsion having silver halide grains and a binder, comprising the steps of adding thereto, besides a chemically sensitizing agent providing sulphur, an organo-tellurium sensitizing compound providing tellurium in a molar ratio amount versus sulphur of less than 0.30. A light-sensitive silver halide photographic element has also been described which has been made highly sensitive by chemically sensitizing a silver halide emulsion which has been made highly sensitive by the method described here-inbefore.

10 Claims, No Drawings

PHOTOSENSITIVE SILVER HALIDE ELEMENT COMPRISING CHEMICALLY SENSITIZED EMULSION GRAINS AND METHOD TO PREPARE THEM

Benefit is claimed under 35 USC 119(E) based on provisional application Serial No. 60/147,386 filed Aug. 6, 1999.

FIELD OF THE INVENTION

The present invention relates to a method of preparing a highly photosensitive image-forming element and more particularly to a highly sensitive photographic silver halide emulsion having an improved speed in the presence of an organo-tellurium compound.

BACKGROUND OF THE INVENTION

In photographic industry there exists an ever lasting demand for photosensitive image-forming materials with increased sensitivity and image-quality. However both characteristics are often dependent on each other or inter-related which means that influencing one parameter will have its consequences for the other parameter and vice versa. This relationship can clearly be proved in testing silver halide photographic materials. So an increase of sensitivity or speed of a photographic silver halide material can be realized by an increase of the mean size of the silver halide emulsion crystals of the said material. This however normally results in a decrease of image quality. One way to solve this problem is to increase the efficiency of electron-trapping of the latent-image in the silver halide grains. This can be realized by chemical sensitization of the grains in the presence of a chemical compound which can enhance the electron-trapping efficiency as mentioned hereinbefore. Such compound may be a sulphur salt, a gold salt or a combination of both as normally used. In the recent years chemical sensitization in the presence of a labile selenium and even of a labile tellurium compound is increasingly used.

Examples of selenium compounds which were suggested for use in order to get an increased sensitivity were substituted selenourea (as described e.g. in EP-A 0 280 031, EP-A 0 458 278), selenoethers (e.g. in JP-A 2-132434, JP-A 4-271341, JP-A 6-175258, U.S. Pat. No. 5,532,120), diselenides (e.g. in EP-A 0 703 492), selenoesters (e.g. in U.S. Pat. No. 5,306,613), selenoketones (e.g. in EP-A 0 476 345), fosfineselenides (e.g. in EP-A 0 506 009), diselenides as in EP-A 0 889 354 and compounds grafted on an anchimeric long-chain group as in EP-A 0 895 121. Especially with the mentioned diselenides it has been shown that a suitable fog-speed relationship can be realized.

A variety of inorganic and organic tellurium complexes as chemically sensitizing compounds have been described as in CA 800,985 (elemental tellurium), sodium telluride and hydrogen telluride (GB 1,295,462) and sodium thiosulfato-telluride (GB 1,396,696). Specific complexes like stable palladium-tellurium complexes have been described in GB 2,316,184. Organo-tellurium compounds have been described in EP-A's 0 350 903, 0 572 662, 0 572 663, 0 573 649, 0 573 650, 0 619 515, 0 542 306, 0 661 589 and in U.S. Pat. Nos. 3,284,206; 4,076,537; 4,148,659; 4,188,218; 4,251,623; 5,215,880; 5,273,872; 5,273,874; 5,296,345, 5,340,695; 5,393,655; 5,395,745; 5,459,027; 5,561,033; 5,654,134; 5,677,120 and 5,759,760 and in DE-A's 1 96 16498, 1 96 19443, 1 96 48013 and 1 98 43081.

More recently synthesized tellurium compounds have been described in EP-A 0 809 137.

However tellurium sensitization easily tends to cause fog as a result of the depth of the electron trap(s) of the formed sensitivity speck(s) which is (are) larger than the depth of the sensitivity speck(s) created by selenium sensitization or sulphur sensitization. At the same time the stability and the gradation of a tellurium sensitized emulsion decreases if no precautions are taken. Special progress was announced by Yagihara M. in EP-A 0 585 787, describing chemical sensitization with sulphur, selenium or tellurium compounds like $R_1CO—Se—X—COR_2$ where $R_1$ and $R_2$ equals alkyl, aryl or heterocycle and X equals S, Se or Te. Most of the patents dedicated to selenium sensitization like the ones mentioned hereinbefore are directed to the prevention of the described disadvantages. Moreover it is further known that sulphur or selenium sensitization carried out in the presence of a gold salt causes an increase in sensitivity but at the same time an unacceptable fog formation too. Particulary in comparison with gold-sulphur sensitization gold-selenium sensitization and even to a greater extent gold-tellurium sensitization causes a remarkable rise in fog. However until now the mechanism causing most of these effects is not fully understood yet and a lot of work has to be done in order to get fundamental improvements in the prevention of fogging or at least to get fog at an acceptable level in order to provide emulsions suitable for use in practical material applications. Accordingly there has been a strong demand for tellurium compounds offering a substantial speed increase while controlling fog to an acceptable low level. All the patents mentioned hereinbefore are to a certain extent more or less failing in disclosing a method for realizing highly sensitive silver halide emulsions with an acceptable fog level by using the tellurium compounds described therein.

OBJECTS OF THE INVENTION

It is therefore a first object of the present invention to provide a highly sensitive photographic element with an improved sensitivity-fog-relationship.

It is another object of the invention to provide a highly photosensitive silver halide emulsion comprising practically useful chemical tellurium sensitizers.

It is a further object of the invention to provide a method for chemically sensitizing a silver halide photographic emulsion with a tellurium compound in order to manufacture a highly sensitive photographic material suitable for use in practical applications.

Further objects and advantages of the invention will become apparent from the description hereinafter.

SUMMARY OF THE INVENTION

A method of chemically sensitizing a silver halide emulsion has thus been disclosed, wherein said emulsion has silver halide grains and a binder, said method comprising the steps of adding thereto, besides a chemically sensitizing agent providing sulphur, an organo-tellurium sensitizing compound providing tellurium in a molar ratio amount versus sulphur of less than 0.30.

A light-sensitive silver halide photographic element has also been provided which has been made highly sensitive by chemically sensitizing a silver halide emulsion by the method as described hereinbefore.

DETAILED DESCRIPTION OF THE INVENTION

While the present invention will hereinafter be described in connection with preferred embodiments thereof, it will be understood that it is not intended to limit the invention to those embodiments. On the contrary, it is intended to cover all alternatives, modifications, and equivalents as may be included within the spirit and scope of the invention as defined by the appending claims.

The present invention as described in the summary will now be explained in detail starting with an illustration of organo-tellurium compounds used in order to chemically sensitize silver halide emulsions crystals by the method of the present invention. Said organo-tellurium compounds are satisfying formula (I):

(I)

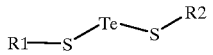

wherein each of $R^1$ and $R^2$ independently represents (C═S)$OR^3$, (C═S)$NR^4R^5$ or (P═S)$R^6R^7$;

wherein each of $R^3$, $R^4$ and $R^5$ independently represents a (substituted or unsubstituted) alkyl, alkenyl, alkynyl, aryl or heteroaryl-group, wherein $R^4$ and $R^5$ may combine to form a ring and wherein each of $R^6$ and $R^7$ independently represents a (substituted or unsubstituted) alkyl, alkenyl, alkynyl, aryl or heteroaryl group, $OR^8$, $NR^9R^{10}$ or $SR^{11}$, wherein $R^8$ to $R^{11}$ are defined as $R^3$ and wherein $R^9$ and $R^{10}$ may combine to form a ring.

Another preferred group of compounds which are useful in the method of the present invention in order to get chemically sensitized silver halide emulsions having showing high speed is represented by formula (II):

(II)

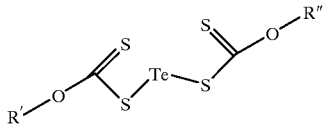

wherein each of R' and R" independently represents a (substituted or unsubstituted) alkyl, alkenyl, alkynyl, aryl or heteroaryl group.

In a particular embodiment the compound according to the formula (III) is a preferred organo-tellurium compound for use in the method of the present invention:

(III)

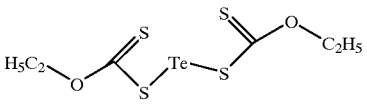

The amount of the organo-tellurium chalcogenic compound according to the formulae (I)–(III) given hereinbefore for use in the method of the present invention is varying depending on the type of said compound used, the type of silver halide grain, the conditions of chemical sensitization, etc.

According to the method of the present invention the molar ratio of the organic compound(s) providing tellurium and of the compound(s) providing sulphur should be less than 0.30, preferably in the range from 0.05 up to 0.25, and still more preferable in the range from 0.08 up to 0.24, in order to provide highly sensitive light-sensitive emulsions for use in light-sensitive materials with an optimized speed-fog relationship. This means that a higher speed is attained with an acceptable fog level than in conditions departing from those as described in the method of the present invention and, more particularly, wherein the same speed-fog relationship cannot be attained in the absence of the organo-tellurium compounds as described.

In order to get enough speed by the process of chemically ripening or sensitizing the silver halide emulsion crystals it is clear that an amount of sulphur should be provided in the range from $1\times10^{-7}$ mole up to $1\times10^{-3}$ mole per mole of silver, and more preferably in the range from $5\times10^{-6}$ mole up to $5\times10^{-5}$ mole per mole of silver, depending on the specific grain surface and grain volume.

Introduction of the organo-tellurium chemical sensitizer may be performed in various ways before starting the chemical sensitization procedure. Tellurium sensitizers which are more or less soluble in water can be added to the dispersion of silver halide crystals as an aqueous solution and, if desired, can be mixed up with a water soluble organic solvent. Organo-tellurium sensitizers which are not water soluble can be introduced after solving the compound in a water soluble organic solvent which is normally used for the introduction of water insoluble products in a photographic silver halide emulsion. An alternative way in order to introduce an insoluble chemical chalcogenic sensitizer is making use of an "oil-in-water" dispersion or, if desired, a dispersion as disclosed in EP-A 0 703 492. In that patent application the said compound is therefore added to the silver halide emulsion before chemical sensitization in the form of a solid partical dispersion in water. So in a particular embodiment addition of tellurium(II) complexes as sensitizers having low solubility in water and/or in an organic solvent to a silver halide emulsion as those described in U.S. Pat. No. 5,677,120 is advantageously performed in form of an aqueous solid particle dispersion as has been described in U.S. Pat. No. 5,759,760.

In another embodiment the tellurium compound used in the method according to the present invention is added as a zeolite loaded PUG as has been described in EP-A 0 909 981, wherein the said PUG or photographically useful group is corresponding with the said tellurium compound. Measures in order to provide suitable addition methods of the organo-tellurium sensitizing complexes or compounds are especially in favour of stability under ambient keeping conditions.

The chemical sensitization with compounds satisfying formula (I) or (II), added in the method of the present invention, which includes the preferred compound according to formula (III), is preferably carried out in the presence of a silver halide solvent like e.g. a thiocyanate salt. This can be added as a sodium, a potassium or preferably as an ammonium salt without however being limited thereto. Thiocyanate salt can be added before, during or after the addition of said compound of the present invention and before, during or after the addition of any other chemical sensitizer which can be used together with the said organo-tellurium sensitizer. The amount of the thiocyanate which is present together with the said chemical sensitizer is limited between $10^{-6}$ and $10^{-1}$ mole per mole of silver halide and preferably situated between $10^{-5}$ and $10^{-2}$ mole per mole of silver halide.

The organo-tellurium compounds of the present invention can be used in combination with other known chemical sensitizers, wherein besides other organic or inorganic tellurium compounds providing tellurium to the silver halide grain, compounds providing sulphur, selenium and noble metals (like gold as the most well-known) are not excluded.

The tellurium sensitization itself can be carried out in the presence of a sulphur compound and if desired in the presence of a noble metal (e.g. gold). The tellurium sensitization can be used in combination with a reduction sensitization too.

In the noble metal sensitization a salt of a noble metal (e.g., gold, iridium, palladium, platinum) is used but gold salts are preferably used in the method of the present invention as noble metal sensitizers. Examples of gold sensitizers include chloroauric acid, goldsulfide, chloroaurate salts, aurithiocyanate, gold selenide and gold telluride. The amount of the noble metal sensitizer may vary between $10^{-8}$ and $10^{-2}$ mole per mole of silver halide.

Sulphur sensitization can be carried out with sulphur compounds like thiosulphates, thioureas, rhodamines, etc. The sulphur sensitizer can be used in an amount of about $10^{-8}$ to $10^{-2}$ mole per mole of silver halide provided that, according to the method of the present invention, besides said chemically sensitizing agent providing sulphur, an organo-tellurium sensitizing compound providing tellurium is added in a molar ratio amount versus sulphur of less than 0.30.

Reduction sensitization is characterized by treatment of the silver halide emulsion with a reducing compound like thioureum dioxide, hydrazine derivatives, sulphinic acid, polyamine compounds, stannous chloride, borane compounds, reductones like ascorbic acid, etc. Reduction sensitization can also be carried out at a low pAg or a high pH or at both and if desired at elevated temperature. This kind of sensitization is referred to as "silver ripening". More information about it can be found in Research Disclosure, Vol. 307, item 307105, p. 863–885, published November 1989, and in P. Glafkides "Chimie et Physique Photographic", P.Montel—Paris, $5^{th}$ Ed.,1987.

The method of preparing a photosensitive element according to the present invention thus comprises as an essential feature the step of chemically sensitizing at least one silver halide emulsion in the presence of the organo-tellurium compound preferably represented by formula (I) or (II), besides a chemically sensitizing agent providing sulphur, in a molar ratio amount of tellurium versus sulphur of less than 0.30. The chemical sensitization described in the method of the present invention is further preferably carried out under conditions of pAg in the range of 6 to 11, but preferably between 7 and 10, in conditions of pH in the range of 3 to 10, preferably 4 to 8.5, while the temperature is situated in the range between 40 to 95 degrees C, preferably between 45 to 85° C.

The silver halide emulsion which should be treated with chemically sensitizing agents in order to become highly light-sensitive as disclosed in the method of the present invention can be prepared in various ways by conventional methods. After a nucleation step, optionally followed by a physical ripening step, one or more grain growth step(s) make(s) the formed nuclei further grow. In the growth step or steps of emulsion preparation reactants are added to the reaction vessel in form of solutions of silver and halide salts or in the form of preformed silver halide nuclei or fine grains which easily dissolve in the precipitation medium due to their size (up to at most about 0.050 $\mu$m) and/or composition (e.g. high solubility of preformed grains rich in silver chloride is much higher than for preformed grains rich in silver bromide, which has in turn a much higher solubility product than silver iodide).

The individual reactants can be added through surface or subsurface delivery tubes by hydrostatic pressure or by an automatic delivery system for maintaining control of pH and/or pAg in the reaction vessel and of the rate of the reactant solutions introduced in it. The reactant solutions or dispersions can be added at a constant rate or a constantly increasing, decreasing or fluctuating rate, if desired in combination with stepwise delivery procedures.

More details about the possible ways in making a silver halide emulsion which can principally be used in this invention are summarized in Research Disclosure No. 38957 (published September 1996) section I-C.

Besides the individual reactants required in order to form silver halide crystals additional chemical metal salts can be added for occlusion in the crystal lattice. Such compound is replacing an appropiate of silver and halide ions in the silver halide lattice. These products or so-called dopants can be distinguished from the metal complexes which are added just before coating as an additive by EPR- or ENDOR-technique. These dopants can be used to modify the crystal structure or the crystal properties and can therefore be employed to influence many photographical properties like sensitivity, reciprocity failure, gradation, pressure sensitivity, fog, stability, etc. When coordination complexes or even oligomeric coordination complexes are used the different ligands bound at the central metal ion can be occluded in the crystal lattice too and in this way influence the photographic properties of the silver halide materials as well. Dopants which are introduced in emulsions of the present invention are those which can act as a permanent or as a non-permanent electron trap as has e.g. been illustrated in EP-A 0 862 084, in EP-A 0 922 994 or in EP-A 0 945 755.

The doping procedure itself can normally be executed at any stage during the grain growth phase of the emulsion preparation. It is important to know that the dopants can also be added in an indirect way by the addition of a dispersion containing very fine soluble silver halide grains or nuclei comprising the dopant. More additional information about the introduction and the use of dopants in the emulsion crystals of this invention can be found in Research Disclosure, 38957 (September 1996), section I-D.

The photographic emulsions prepared in this way contain silver halide crystals comprising chloride, bromide or iodide alone or in combination thereof. Other silver salts which can be incorporated in a limited amount in the silver halide lattice are silver phosphate, silver thiocyanate, silver citrate and some other silver salts like silver formate. The chloride and bromide halide can be combined in all ratios in order to form a silver chlorobromide salt. Iodide ions however can be coprecipitated with chloride and/or bromide ions in order to form a iodohalide with an iodide amount which depends on the saturation limit of iodide in the crystal lattice with the given halide composition. So up to a maximum amount of about 40 mole percent in silver iodobromide and up to at most 13 mole percent in silver iodochloride both based on silver can be built in. Silver halide emulsions having at least 50 mole % of silver chloride and chemically sensitized with organo-tellurium compounds have been described in U.S. Pat. No. 5,340,695.

The composition of the halide can change in the crystal in a continuous or discontinuous way. Emulsions containing crystals composed of various sections with different halide compositions are used for several photographic applications. So a structure with a difference in halide composition between the center and the rest of the crystal (what is called "core-shell"-emulsion) or with more than two crystal parts differing in halide composition (called a "band"-emulsion) may occur. Changes in halide composition can be realized by direct precipitation or in an indirect way by a so-called "conversion step", wherein fine silver halide grains of a certain halide composition are dissolved in the presence of the so-called host grains forming a "shell" or "band" on the given grain.

Crystals formed by the emulsion preparation methods described above have a morphology which can be tabular or non-tabular. In one embodiment according to the method of the present invention a light-sensitive silver halide photographic emulsion has been provided, wherein emulsion grains have been doped with a compound (called "dopant") providing shallow electron traps (SET's). It is clear that special attention should be paid to the way in which dopants are introduced during crystal growth as the stability of the dopants in complex compounds may be limited, depending on the solutions wherein the said compounds are available. Therefore said solution can be introduced by means of a so-called "third-jet" in order to introduce the dopant in the reaction vessel where rapid incorporation in the growing crystals is performed. In a preferred embodiment e.g. said third-jet is adding the dopant solution in the vicinity of the stirrer, where also new rapidly dissolving fine grain nuclei are formed which are precipitated further onto growing tabular crystals. In order to provide a preferred hole trapping action for the emulsion crystals when exposed to radiation, presence in the said crystals of an organic hole trapping dopant (as e.g. those chosen from carboxylic acid salts—as formates described in EP-A 0 922 994—or alpha hydroxy sulphenic acid salts as described in EP-A 1 006 401) is not excluded, and even preferred in order to further improve the fog-speed relationship of the emulsions prepared according to the method of the present invention.

Dopants used in the preparation method of tabular silver halide crystals, which can also be added to the tabular grains of the present invention are e.g. Ir (see U.S. Pat. Nos. 5,164,292; 5,399,476; 5,807,667) or group VIII metal ions as has e.g. been described in EP-A's 0 503 736 and 0 515 894. Most frequently occurring dopants in literature are ruthenium, rhodium and iridium. Combinations of one or more dopant(s) may be added, in the same or different preparation steps of tabular silver halide crystals. Particularly with respect to the said tabular grains hole trapping dopants may be advised as those chosen from carboxylic acid salts—as formates—or alpha hydroxy sulphenic acid salts as described in EP-A 1 006 401. Further addition of small amounts of e.g. iridium compounds (as potassium hexachloroiridate (III)) added during and/or at the end of the precipitation step and/or in the chemical ripening step is highly preferred and may lead to a positive effect on processing latitude, in that e.g. less differences in sensitivity and gradation are observed after fluctuations in developing time within a range of about 5 seconds and in processing temperature within a range of about 10° C. Said emulsion having shallow electron traps preferably comprises a binder and core-shell tabular grains doped with a dopant, characterized in that said grains contain as a dopant a compound providing shallow electron traps (more preferably a hexacyano complex of ruthenium), said complex being present in the core of said core-shell tabular grains and wherein said core represents an amount of precipitated silver halide extending up to at most 95% of all precipitated silver halide (more preferably extending up to at most 80% of all precipitated silver halide) as disclosed in EP-Application No. 99201625, filed May 25, 1999. In tabular crystals the aspect ratio (ratio of equivalent circular diameter to thickness) can vary from "low" (<2) over "medium" (from 2 to 8) to "high" (more than 8) where especially in the case of the ultra thin tabular crystals high aspect ratios can be realized. The major faces of the formed tabular grains can have a {111} or a {100}-habit. The structure which is considered to be more stable for {100} tabular grains (in analogy with stable cubic grains having (100) faces) has, opposite thereto, to be stabilized for thermodynamically unstable {111} tabular grains (by a "habit modifying agent" like adenine as an example of the preferred aminoazaindenes). Chemical sensitization with organo-tellurium compounds of {100} tabular grains has been described in U.S. Pat. No. 5,665,530. In the class of non-tabular grains there are a lot of possibilities which can be divided in the more regular shaped crystals (cubic or octahedral crystals having (100) or (111) faces respectively) or crystals with a mixed crystal habit like cubo-octaeders.

Depending on the application it may be important to apply a well-defined amount of iodide on the crystal surface under controlled conditions in order to get reproducible sensitometric results after image-wise exposure followed by subsequent processing. This can be done by using an iodide releasing agent as described in EP-A 0 561 415 and in EP-A 0 563 708 and applied on emulsions before, during or after chemically sensitization in addition to the method and the conditions of the present invention as described hereinbefore.

In a preferred embodiment according to the method of the present invention the emulsions chemically sensitized as described hereinbefore, whether or not doped with one or more compounds providing shallow electron traps, have grains composed of silver bromide, silver chloride, silver iodide or a combination thereof.

A hydrophilic colloid is used as a binder or a protective colloid for the emulsion or any other layer of the photographic material of the invention. Gelatin is the most well-known and advantageously used hydrophilic colloid. The preparation of conventional lime-treated or acid-treated gelatin which is suitable for use in the emulsions and materials of the present invention has been described in e.g. "The Science and Technology of Gelatin", edited by A. G. Ward and A. Courts, Academic Press 1977, page 295 and further. The gelatin can also be enzyme-treated as described in Bull.Soc.Sci.Phot.Japan, Nr 16, page 30 (1966).

Gelatin may, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents, by grafting of polymerisable monomers on gelatin or prehardened gelatins with blocked functional groups as a consequence of this prehardening treatment, cellulose derivatives such as hydroxyalkyl cellulose, carboxymethyl cellulose, phthaloyl cellulose, and cellulose sulphates and even potato starch.

Further synthetic high molecular compounds described in JP-B-52-16365, Journal of The Society of Photographic Science and Technology of Japan, Vol. 29(1), 17, 22(1966), ibid., Vol. 30(1), 10, 19(1967), ibid., Vol. 30(2), 17(1967), and ibid., Vol. 33(3), 24(1967) may be used as a dispersion medium. Also the crystal habit restraining agent described in EP-A 0 534 395 may be used.

Part of gelatin may further be replaced with a synthetic or natural high-molecular material. An interesting substitute for gelatin may be silica as has been described in the published EP-A's 0 392 092, 0 517 961, 0 528 476, 0 649 051 and 0

704 749. As has been set forth in EP-A 0 528 476 a method of preparing a silver halide light-sensitive photographic material incorporating layers of silver halide precipitated in colloidal silica serving as a protective colloid is given. In this document the silver halides are prepared in colloidal silica, leading to emulsion crystals that are stable at the end of the precipitation, without however having a predictable mean crystal diameter and crystal size distribution.

These problems have been overcome as described in EP-A 0 682 287, for the preparation of crystals rich in silver chloride, wherein clearly defined circumstances wherein such crystals can be prepared: during the precipitation stage of regular silver chloroiodide crystals amounts of silica sol and of stabilizing onium compound(s), should be optimized in order to avoid uncontrolled formation and growth of aggregates. Still another useful binder is cationic oxidized starch as has been described in U.S. Pat. Nos. 5,607,828; 5,667,955 and in 5,733,718; as well as in EP-A 0 758 758.

Emulsions prepared according to the method of the present invention have as a binder gelatin, colloidal silica sol or cationic oxidized starch, without however excluding combinations thereof.

The emulsions can be coagulated and washed after precipitation in order to remove the excess soluble salts. These procedures well-known in-the-art are used apart or together with alternative methods like dia- or ultrafiltration and ion-exchange as described e.g. in Research Disclosure, No. 38957 (September 1996), section III. Additional gelatin or another hydrophilic colloid, suitable for use as a binder material can be added at a later stage of emulsion preparation, e.g. after washing, in order to establish optimal coating conditions and/or in order to establish the required thickness of the coated emulsion layer. Preferably a gelatin to silver halide ratio, silver halide being expressed as the equivalent amount of silver nitrate, ranging from 0.3 to 1.0 is then obtained. Another binder may also be added instead of or in addition to gelatin. Useful vehicles, vehicle extenders, vehicle-like addenda and vehicle related addenda have been described e.g. in Research Disclosure N° 38957 (1996), Chapter II.

The silver halide emulsion crystals chemically sensitized in the method of the present invention which are prepared in one of the ways described hereinbefore preferably contain crystals which have a spherical equivalent diameter (SED) of not more than 1.5 $\mu$m but preferable less than 1.0 $\mu$m. The spherical equivalent diameter (SED) of the crystal represents the diameter of the sphere which has the same volume as the average volume of the silver halide crystals of the said emulsion. In a preferred embodiment emulsions the grains of which have been chemically sensitized according to the method of the present invention are those wherein said grains have a {111} crystal habit with an aspect ratio of more than 2, more preferably from 5 up to 25; an average equivalent crystal diameter of at least 0.5 $\mu$m, more preferably from 0.6 $\mu$m up to 2.0 $\mu$m; an average thickness of from 0.06 to 0.30 $\mu$m, more preferably from 0.06 up to 0.20 $\mu$m and wherein said grains are accounting for a total projected area of at least 90% with respect to all grains. In a further preferred embodiment said emulsion has tabular grains which have a hexagonal {111} crystal habit with a procentual variation coefficient on average crystal diameter of 25% or less.

The emulsions can be surface-sensitive emulsions which form latent images primarily on the surface of the silver halide grains or they can be emulsions forming their latent-image primarily in the interior of the silver halide grain. The emulsions can further be negative-working emulsions such as surface sensitive emulsions or unfogged internal latent image-forming emulsions. However direct-positive emulsions of the unfogged, latent image-forming type which are positive-working by development in the presence of a nucleating agent, and even pre-fogged direct-positive emulsions can be used in the present invention.

Silver halide emulsions chemically sensitized by the method of the present invention may be further spectrally sensitized with dyes from different classes which include polymethine dyes comprising cyanines, merocyanines, tri-, tetra- and polynuclear cyanines and merocyanines, oxanols, hemioxanols, styryls, merostyryls and so on, depending on the application (light or energy source for which the material comprising said emulsions should be sensitive). Sometimes more than one spectral sensitizer may be used in the case that a larger part of the spectrum has to be covered. Combinations of several spectral sensitizers are sometimes used in order to get supersensitization, which means that in a certain region of the spectrum the sensitization is greater than that from any concentration of one of the dyes alone or that which would result from the additive effect of the dyes. Generally supersensi-tization can be attained by using selected combinations of spectral sensitizing dyes and other addenda such as stabilizers, development accelerators or inhibitors, brighteners, coating aids, and so on. A good description of all the possibilities in spectral sensitization which can be important with respect to the present invention can be found in Research Disclosure, 38957(September 1996), section V. So in U.S. Pat. No. 5,296,345 spectral sensitization with a combination of (benz)oxazolo- and (benz)imidacarbocyanines, and chemical sensitization with a tellurium compound has been described for tabular silver halide grains with a mean aspect ratio of at least 3 for at least 50% of the total projected area of all silver halide grains having a composition with up to 1 mole % of iodide.

According to the method of the present invention, particularly in case of tabular silver halide grains in the emulsion, spectral sensitization is performed prior to chemical sensitization.

The photographic elements comprising the silver halide emulsions prepared according to the method of the present invention may include various compounds which should be provided as they play a role in the material itself or afterwards in the processing, finishing or warehousing the photographic material. These products can be stabilizers and anti-foggants. Antifoggants prevent occurrence of a fog while a stabilizer has a function of stabilizing photographic properties. Antifoggant and stabilizer are used in preparation, storage or processing step of the photographic material. Antifoging agents and stabilizers may be azoles, mercaptopyrimidines, mercaptotriazines, azaindenes, etc. Further suitable examples are e.g. those described in Research Disclosure, 38957(September 1996), section VII. Hydrophilic colloidal layer (silver halide emulsion layer, backing layer, antihalation layer, etc.) of the photographic material comprising emulsions prepared according to the method of the present invention may contain an inorganic or an organic hardening agent (see Research Disclosure, 38957 (September 1996) section IIB), brighteners (see Research Disclosure, 38957(September 1996) section VI), light absorbers and scattering materials (see Research Disclosure, 38957 (September 1996) section VIII), coating aids (see Research Disclosure, 38957(September 1996) section IXA), antistatic agents (see Research Disclosure, 38957 (September 1996) section IXC), matting agents (see Research Disclosure, 38957(September 1996) section IXD) and development modifiers (see Research Disclosure, 38957

(September 1996) section XVIII). Said photographic elements may further comprise various other additives such as e.g. compounds improving the dimensional stability of the photographic element, ultraviolet absorbers and spacing agents. Suitable additives for improving the dimensional stability of the photographic element are e.g. dispersions of a water-soluble or hardly soluble synthetic polymer e.g. polymers of alkyl(meth)a-crylates, alkoxy(meth)acrylates, glycidyl (meth)acrylates, (meth)a-crylamides, vinyl esters, acrylonitriles, olefins, and styrenes, or copolymers of the above with acrylic acids, methacrylic acids, α,β-unsaturated dicarboxylic acids, hydroxyalkyl (meth)acry-lates, sulphoalkyl (meth)acrylates, and styrene sulphonic acids. Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 56-2784, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455 and those described in Research Disclosure, 38957 (September 1996) Section VI, wherein also suitable optical brighteners are mentioned. Spacing agents may be present of which, in general, the average particle size is comprised between 0.2 and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Prior to coating any thickening agent may be used in order to regulate the viscosity of the coating solution, provided that they do not particularly affect the photographic characteristics of the silver halide emulsion in the coated photographic material. Preferred thickening agents include aqueous polymers such as polystyrene sulphonic acid, dextran, sulphuric acid esters, polysaccharides, polymers having a sulphonic acid group, a carboxylic acid group or a phosphoric acid group as well as colloidal silica. Polymeric thickeners well-known from the literature resulting in thickening of the coating solution may even be used in combination with colloidal silica. Patents concerning thickening agents are e.g. U.S. Pat. No. 3,167,410; Belgian Patent No. 558.143 and JP-A's 53-18687 and 58-36768. Negative effects on physical stability possibly resulting from the addition of polymeric compounds can be avoided by exclusion of those compounds and by restricting extra additions of colloidal silica.

In order to reach a high hardening degree the layer binder should of course dispose of an acceptably high number of functional groups, which by reaction with an appropriate hardening agent can provide a sufficiently resistant layer. Such functional groups are especially the amino groups, but also carboxylic groups, hydroxy groups, and active methylene groups. Hardeners may be added to the antistress layer, covering one or more light-sensitive silver halide emulsion layers before or during the coating procedure, or to one or more of the said emulsion layers. The binders of the photographic element, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxydioxan, active vinyl compounds e.g. 1,3,5-triacryloyl-hexa-hydro-s-triazine, active halogen compounds e.g. 2,4-dichloro-6-hydroxy-s-triazine, and mucohalogenic acids e.g. mucochloric acid and mucophenoxy-chloric acid. These hardeners can be used alone or in combination. The binders can also be hardened with fast-reacting hardeners such as carbamoylpyridinium salts. Formaldehyde and phloroglucinol can e.g. be added respectively to the protective layer(s) and to the emulsion layer(s). Further suitable possibilities for hardening can be found in Research Disclosure, 38957(September 1996), section IIB.

The photographic elements can be coated on a variety of supports which can be flexible or rigid. The flexible materials include plastic films and papers while the rigid materials include glass, metals, etc. The surface of the support is generally subjected to undercoating treatment (like corona discharge, irradiation with ultraviolet rays, etc.) in order to enhance the adhesion with the silver halide emulsion layer (see Research Disclosure, 38957(September 1996), section XV and the references cited therein). The photographic elements can be exposed to actinic radiation, especially in the visible, near-ultraviolet and near-infrared region of the spectrum, to form a latent image (see Research Disclosure, 38957 (September 1996) section XVI).

Various exposure means can be employed for exposure of the photographic material comprising emulsions prepared according to the method of the present invention. As the light source, any optional light source releasing a radiation corresponding to the sensitivity wavelength of the photographic material can be employed. Examples of the light sources generally used include natural light, incandescent lamp, halogen lamp, mercury lamp, fluorescent lamp and all types of flash light sources. Light sources that emit light in the ultraviolet to infrared region can be also used as recording light sources. Photographic materials can for example also be exposed to gas lasers, semiconductor lasers, light emitting diodes or plasma light sources. In the same way the material can be exposed to a LCD-'light source' or to a fluorescent surface given by a phosphor stimulated with electron rays.

The latent-image formed in the silver halide crystals of emulsions prepared according to the method of the present invention can, after exposure, be processed in order to form a visible image. Therefore various methods are known and many developing, fixing and. stabilizing agents are described for the formation of photographic silver image. The know-how for processing photographic silver halide materials which can principally be used in relation with the present invention is described in Research Disclosure, No. 176043, December 1978; sections XIX to XXIV and in Research Disclosure, 38957 (September 1996) section XIX). Presence of specified stabilizing agents like e.g. thiazoles, mercaptanes or polysulfide compounds is in favour of reaching low fogging levels and, to a certain extent, as illustrated in U.S. Pat. No. 5,654,134, in favour of reciprocity law characteristics.

In the conventional way of processing most of the materials comprising emulsions prepared according to the method of the present invention, are developed by means of a liquid containing hydroquinone as main developing agent usually in combination with a so-called auxiliary developer. In an alternative way of processing hydroquinone is incorporated in the photographic material itself while the processing liquid is an mere alkaline solution. However it is important to realize that hydroquinone is suspect in various ways especially from an ecological and medical point of view. The present invention is therefore also related with a more ecological way of processing, wherein hydroquinone is, at least partly, replaced by ascorbic acid as developing agent. Ascorbic acid should be interpreted in a broad sense and includes ascorbic acid isomers, derivatives, salts and analogous compounds (including some reductones and reductic acid derivatives). The most preferred compounds are ascorbic acid, iso-ascorbic acid and their salts. Useful combinations of developers containing an ascorbic acid developing agent which should be preferably used in the scope of the present invention is described for many applications (in graphic materials, radiography, non-destructive testing materials, micrography, laser materials, etc.) in Research Disclosure No. 37152(March 1995), pages 185–224.

The photographic emulsions prepared according to the method of the present invention can be used in various applications as described e.g. EP-A's 0 794 456 and 0 862 088 for laser imaging (hard-copy materials) and radiological imaging respectively (silver halide photographic emulsion suitable for use in single-side and double-side coated radiographic materials respectively, combined with intensifying screens provided with luminescent phosphors emitting light for which the silver halide photographic materials are light-sensitive and thus made suitable for use in medical diagnosis), but also in multi-layered multicolour materials. These multicolour materials comprise a support and two or more silver halide emulsion layers that have different spectral sensitivities. The multi-layered colour photographic material generally comprises at least one red-sensitive emulsion layer, at least one green-sensitive emulsion layer and at least one blue-sensitive emulsion layer on a support. A non-light sensitive layer may be provided between two or more emulsion layers having the same colour sensitivity. Otherwise, another emulsion layer having a different colour sensitivity can be provided between two or more emulsion layers having the same color sensitivity. A light-reflecting layer such as a layer of silver halide grains can be provided under a high sensitive layer, particularly under a high blue-sensitive layer in order to enhance the sensitivity.

The silver halide material can also contain different types of couplers which can be incorporated in colour photographic materials. The red-sensitive emulsion layer contains generally a cyan coupler, the green-sensitive layer generally contains a magenta coupler and the blue-sensitive emulsion layer generally contains a yellow coupler. All the information which can be important for the application of the present invention in these type of materials is extensively described in Research Disclosure, 38957(September 1996) section X. More information with respect to the various colour applications which belong also to the scope of the present invention, can be found in U.S. Pat. No. 5,532,120. Processing in order to form a visible dye image for colour materials means contacting the element with a colour developing agent in order to reduce developable silver halide and to oxidize the colour developing agent, which in turn normally reacts with a coupler to form a dye (see Research Disclosure, 38957(September 1996) section XX).

According to the present invention single-side or double-side coated silver halide photographic materials are provided comprising a support and coated thereon on one or both sides respectively one or more hydrophilic light-sensitive layers, wherein at least one of said layers comprises a light-sensitive silver halide emulsion prepared according to the method as extensively described and disclosed hereinbefore.

The invention is described hereinafter by way of the following examples without however being limited thereto.

EXAMPLES

Film materials comprising tabular {111} grains rich in silver bromide were the following.

Preparation of silver bromoiodide tabular grain emulsion:

The following solutions were prepared:

2.989 1 of a dispersion medium (C) containing 6.9 ml of potassium bromide, 2.94 M, and 5,5 g of inert gelatin were established at 51° C., pH=1.8, pBr=2.17 (pAg : 9.1);

a 1.96 molar silver nitrate solution (A);

a solution containing 1.96 moles/liter of potassium bromide (B);

Before starting pH was adjusted to a value of 2.5.

A nucleation step was performed by introducing solution A and solution B simultaneously in dispersion medium C both at a flow rate of 24 ml/min during 30 seconds. After a physical ripening time of 7 minutes, the temperature was raised to 70° C. in 25 minutes and after another 7 minutes pH was adjusted to a value of 5.0, making use from a solution of 2 molar of sodium hydroxide.

After addition of 500 ml of a solution of gelatin (10 wt. %) and homogenizing the dispersing liquid in the reaction vessel during 5.5 minutes a first neutralization was performed by addition of solution B at a rate of 30.0 ml per minute for 37 seconds.

A second neutralization step was performed by addition of solution A at a rate of 5 ml/minute during 300 seconds and of solution B at a rate in order to get a UAg value of 10 mV (mV versus sat. Ag/AgCl reference electrode).

Grain growth was performed by addition at a linearly increasing velocity from 5 ml/min. up to 10 ml/min. of 478 ml of solution A in 3824 seconds, while adding solution B at a rate in order to get a constant UAg value of 10 mV.

A third neutralization step was performed by addition of solution A at a constant rate of 5 ml per minute during 395 seconds.

A fourth neutralization step was performed by addition of solution A at a rate of 5 ml/minute during 120 seconds and of solution B at a rate in order to get a UAg value of 60 mV.

Grain growth was performed in a second growth step by addition at a linearly increasing velocity from 5 ml/min. up to 25 ml/min. of 932 ml of solution A in 3728 seconds, while adding solution B at a rate in order to get a constant UAg value of 60 mV.

48.8 ml of a solution of potassium iodide 0.06 M was added in 156 seconds and stirring continued for another 5 minutes.

The pH value of the said dispersing medium was adjusted to a value of 3.5 with sulphuric acid and after cooling to 20° C. the obtained flocculate was decanted and washed twice with an amount of 3 1 of demineralized water (11° C.) in order to remove the soluble salts present. After decanting to a volume of 1.351 l the washing procedure was repeated twice and after the last washing step, followed by sedimentation, decantation was performed in order to have an emulsion volume as low as possible. An emulsion having {111} silver bromoiodide tabular grains having iodide present in an amount of 0.1 mole % was thus obtained. Peptization was further performed by addition of gelatin in order to get a gesi of 0.5 for an emulsion the concentration of which, expressed as an equivalent amount of silver nitrate, of 236 g/kg.

The said silver bromoiodide tabular emulsion showed the following grain characteristics:

an average equivalent volume diameter E.V.D. of 0.75 μm;

an average thickness t of 0.15 μm;

an average aspect ratio AR of 9.0.

a numerical percentage of tabular hexagons of more than 95%.

Data for aspect ratio AR and thickness t, as well as procentual amount of hexagons, were obtained from electron microscopic photographs: the diameter of the grain was defined as the diameter of the circle having an area equal to the projected area of the grain as viewed in the said photographs.

Data for E.V.D. were obtained after computing signals obtained from reduction of individual grains and representative for the volume of each grain before reduction.

Before the start of the chemical ripening the UAg-value of the emulsion was adjusted at +100 mV (against a silver/silver chloride reference electrode) and the pH-value at 6.0 with sodium hydroxide. Chemical ripening agents were adapted to the crystal size of the emulsions: amounts are given in the Table 1 hereinafter.

Chemical ripening agents were gold thiocyanate, sodium thiosulphate as a source of sulphur, the tellurium compound according to the formula (III) as a source of tellurium and toluene thiosulphonic acid (see formula IV) was used as predigestion agent. As stabilizing agent in the chemical ripening p-carboxy-phenyl-mercaptotetrazole (see formula V) was added. The amounts of each chemical ripening agent (given in ml per mole of silver) are represented in Table 1.

The chemical ripening was optimized in order to obtain an optimal fog-sensitivity relationship after 2 hours at 54° C.

(IV)

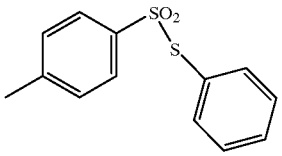

-continued (V)

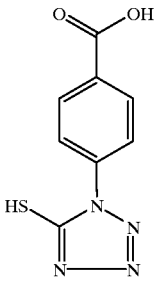

As a first solution KSCN (10 wt % in demineralized water) in an amount of $1.40\times10^{-3}$ mole per mole of silver was added. A predigestion time of 5 minutes was taken after addition of the toluene thiosulphonic acid predigestion solution ($3.24\times10^{-7}$ mole per mole of silver) before addition of 1.134 mmole per mole of silver of the spectrally sensitizing dye (green wavelength range), the formula of which has been given hereinafter (see formula VI):

Green Spectrally Sensitizing Dye (VI)

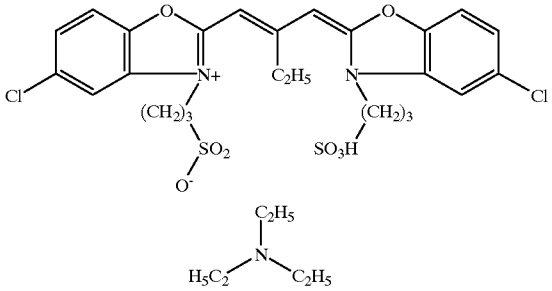

After addition of the said green spectrally sensitizing dye according to the formula (VI), a digestion time of 30 minutes was respected. After said addition another time of 5 minutes was waited before addition of the compounds providing sulphur ($Na_2S_2O_3$.5aq.: 1 ml corresponds with $1.5\times10^{-5}$ mole to be added per mole of silver), organo-tellurium compound (III): 1 ml corresponds with $4.77\times10^{-6}$ mole to be added per mole of silver) and gold ($HAuCl_4$. $4H_2O$: : $3.21\times10^{-6}$ mole to be added per mole of silver).

Stabilizing compound (V) was added as last solution in an amount of $1.28\times10^{-4}$ mole per mole of silver.

All amounts given in the Table 1 are given in ml of the solutions added per mole of silver present in the different emulsion samples Nos. 1–9.

Moreover the molar ratio of tellurium and sulphur has been given in the Table 1. Apart from the Emulsion No. 1 wherein no tellurium compound has been added, the said molar ratio ranges from 1:12 up to 4:3.

TABLE 1

| Comp./EM | 1 | 2 | 3 | 4 | 5 | 6 | 7 | 8 | 9 |
|---|---|---|---|---|---|---|---|---|---|
| $Na_2S_2O_3$.5aq | 1 | 1 | 1 | 1 | 1 | 1 | 0.5 | 0.75 | 0.75 |
| Te-comp. III | 0 | 0.25 | 0.5 | 1 | 2 | 4 | 0.5 | 0.25 | 0.5 |
| $HAuCl_4.4H_2O$ | 1 | 1 | 1 | 1 | 1 | 1 | 1 | 1 | 1 |
| Te/S | — | 0.08 | 0.16 | 0.32 | 0.64 | 1.28 | 0.32 | 0.11 | 0.22 |

Preparation of the Film Materials Nos. 1–9.

After addition of the normal coating additives to each emulsion the solutions were coated simultaneously together with a protective layer containing 1.3 g gelatine per $m^2$ per side on both sides of a polyethylene terephthalate film support having a thickness of 175 $\mu$m. Materials were numbered in the Table 2 hereinafter in the same way as the emulsions in the Table 1 above.

The resulting photographic material contained per side an amount of silver halide corresponding to 3.5 grams of $AgNO_3$ per $m^2$ and an amount of gelatin corresponding to 2.8 g/$m^2$.

The processing was run in the developer G138®, followed by fixing in fixer G335® and rinsing at the indicated temperature of 35° C. for a total processing time of 45 seconds. The said developer and fixer are trademark products from Agfa-Gevaert Nev.

Sensitometric data are expressed for

"fog" levels F, calculated as difference of the measured density in the minimum density range and density of the film support: figures obtained are calculated with a factor of 1000;

speed values $S_{0.2}$ and $S_{1.0}$, determined at a density of 0.2 and 1.0 above minimum density, wherein said values (logarithmic values) are multiplied by a factor of 100: a decrease with 30 units is indicative for a doubling in speed;

gradation level G, are determined between a density of 0.2 and 1.0 above minimum density: : figures obtained are calculated with a factor of 100.

In Table 2 results are summarized for the different film materials after exposure and processing as set forth above.

TABLE 2

| Material No. | Fog (× 100) | Speed (× 100) | Gradation (× 100) |
|---|---|---|---|
| 1 (ref.) | 190 | 156 | 290 |
| 2 (inv.) | 202 | 151 | 295 |
| 3 (inv.) | 205 | 150 | 291 |
| 4 | 220 | 154 | 279 |
| 5 | 243 | 168 | 264 |
| 6 | 296 | 193 | 243 |
| 7 | 205 | i56 | 268 |
| 8 (inv.) | 196 | 155 | 277 |
| 9 (inv.) | 209 | 149 | 289 |

From Table 2 it can be concluded that besides a chemically sensitizing agent providing sulphur, an organo-tellurium sensitizing compound providing tellurium in a molar ratio amount versus sulphur of less than 0.25 or 1:4 as is the case for Materials Nos. 2, 3, 8 and 9 provides a material having a sufficiently high speed with an acceptable fog level if compared with the reference material No. 1.

Higher values for said molar ratio are leading to an enhanced fog level, a decreased speed and too low a gradation value.

Having described in detail illustrative examples of the current invention, it will now be apparent to those skilled in the art that numerous modifications can be made therein without departing from the scope of the invention as defined in the appending claims.

What is claimed is:

1. Method of chemically sensitizing a silver halide emulsion having silver halide grains and a binder, comprising the steps of adding thereto, besides a chemically sensitizing agent providing sulphur, an organo-tellurium sensitizing compound providing tellurium in a molar ratio amount versus sulphur of less than 0.30.

2. Method according to claim 1, wherein said organo-tellurium sensitizing compound is a compound according to the general formula (I):

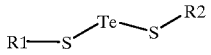

(I)

wherein each of $R^1$ and $R^2$ independently represents $(C{=}S)OR^3$, $(C{=}S)NR^4R^5$ or $(P{=}S)R^6R^7$; wherein each of $R^3$, $R^4$ and $R^5$ independently represents an alkyl, alkenyl, alkynyl, aryl or heteroaryl-group, wherein $R^4$ and $R^5$ may combine to form a ring and wherein each of $R^6$ and $R^7$ independently represents an alkyl, alkenyl, alkynyl, aryl or heteroaryl group, $OR^8$, $NR^9R^{10}$ or $SR^{11}$, wherein $R^8$ to $R^{11}$ are defined as $R^3$ and wherein $R^9$ and $R^{10}$ may combine to form a ring.

3. Method according to claim 1, wherein said organo-tellurium sensitizing compound is a compound according to the formula (II)

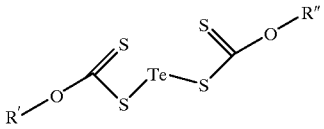

(II)

wherein each of R' and R" independently represents an alkyl, alkenyl, alkynyl, aryl or heteroaryl group.

4. Method according to claim 1, wherein sulphur is present in an amount of from $5\times10^{-6}$ mole up to $5\times10^{-5}$ mole per mole of silver.

5. Method according to claim 1, wherein said binder is gelatin, colloidal silica sol or cationic oxidized starch.

6. Method according to claim 1, wherein said grains are composed of silver bromide, silver chloride, silver iodide or a combination thereof.

7. Method according to any of claim 1, wherein said grains have been doped with a compound providing shallow electron traps.

8. Method according to claim 1, wherein said grains have a {111} crystal habit with an aspect ratio of more than 2, an average equivalent crystal diameter of at least 0.5 $\mu$m, an average thickness of from 0.06 to 0.30 $\mu$m and wherein said grains are accounting for a total projected area of at least 90% with respect to all grains.

9. Method according to claim 8, wherein said tabular grains have a hexagonal {111} crystal habit with a procentual variation coefficient on average crystal diameter of 25% or less.

10. Single-side or double-side coated silver halide photographic material comprising a support and coated thereon on one or both sides respectively one or more hydrophilic light-sensitive layers, wherein at least one of said layers comprises a light-sensitive silver halide emulsion according to claim 1.

* * * * *